United States Patent [19]

Stenneler

[11] Patent Number: 5,044,886

[45] Date of Patent: Sep. 3, 1991

[54] ROTOR BLADE FIXING PROVIDING IMPROVED ANGULAR ALIGNMENT OF SAID BLADES

[75] Inventor: Jacques M. P. Stenneler, Le Chatelet En Brie, France

[73] Assignee: Societe Nationale d'Etude et de Moteurs d'Aviation "S.N.E.C.M.A.", Paris, France

[21] Appl. No.: 491,209

[22] Filed: Mar. 9, 1990

[30] Foreign Application Priority Data

Mar. 15, 1989 [FR] France ..... 89 03374

[51] Int. Cl.[5] ..... F01D 5/30

[52] U.S. Cl. ..... 416/215; 416/193 A; 416/248

[58] Field of Search ..... 416/215, 216, 219 R, 416/500, 193 A, 248

[56] References Cited

U.S. PATENT DOCUMENTS

| | | | |
|---|---|---|---|
| 2,295,012 | 9/1942 | Semar . | |
| 3,902,824 | 9/1975 | Sauer | 416/215 |
| 4,451,204 | 5/1984 | Pask | 416/215 |
| 4,460,315 | 7/1984 | Tseng et al. | 416/215 |
| 4,464,096 | 8/1984 | Trousdell et al. | 416/215 |
| 4,465,432 | 8/1984 | Mandet et al. | 416/215 |
| 4,818,182 | 4/1989 | Bource | 416/215 |
| 4,878,811 | 11/1989 | Jorgensen | 416/215 |

FOREIGN PATENT DOCUMENTS

| | | |
|---|---|---|
| 0081436 | 6/1983 | European Pat. Off. . |
| 1192696 | 4/1959 | France . |
| 137379 | 1/1920 | United Kingdom . |

*Primary Examiner*—John T. Kwon

*Attorney, Agent, or Firm*—Oblon, Spivak, McClelland, Maier & Neustadt

[57] ABSTRACT

Rotor blades having roots of the hammer-head type which are received in a circumferential groove in the rim of a rotor disc to secure the blades on the disc are provided with a raised portion on the underside of the blade platform which extends over the entire circumferential length of the platform and has a width equal to that of the mouth of the groove in the rim of the disc. The root of each blade is mounted on this raised portion, and when the root is received in the groove of the disc the raised portion is received closely in the mouth of the groove to ensure the correct alignment of the blade.

3 Claims, 2 Drawing Sheets

ROTOR BLADE FIXING PROVIDING IMPROVED ANGULAR ALIGNMENT OF SAID BLADES

BACKGROUND OF THE INVENTION

1. Field of the Invention

The present invention relates to the rotor of a compressor or turbine of a gas turbine engine, and is particularly concerned with the fixing of the blades to a disc of the rotor.

2. Summary of the Prior Art

In the compressor stages of small diameter engines, it is known to fasten the blades to the rotor disc by providing the blades with a so-called hammer-head type of root, i.e. a bulbous root which is arranged to fit into a circumferential groove in the rim of the disc having a cross section corresponding to that of the bulbous root.

In more modern engines, the number of blades has been increased, which has necessitated a reduction in the pitch of the blades, and to achieve this it has been necessary to provide the blades with diamond shaped platforms instead of rectangular platforms as previously used.

With these diamond shaped platforms, the centre of aerodynamic thrust on each blade corresponds to a moment which has a tendency to cause the blade to pivot in the groove. This tendency is further accentuated by the presence of circumferential play between the blade platforms to cater for the tolerances in their width and by an increase in the basic clearance resulting from the natural pivoting of the blades.

This pivoting is of course countered by the bulbous roots of the blades, whose active flanks are brought into contact with the sides of the groove in the disc by the action of centrifugal force. However, during the engine starting phase, the centrifugal forces are insufficient to prevent all pivoting of the blades, which results in uneven bearing of the roots in the groove and variations in the setting of the blades.

To avoid this pivoting, present techniques make use of various solutions. For example, one known solution, which is illustrated in FIGS. 1 and 2 of the accompanying drawings, involves providing the inner face of the platform of each blade with rebates 1 and 2 which mate with circumferential ribs 3 and 4 on the rim 5 of the disc, so that the platforms will butt against the disc. This solution has the disadvantage of requiring a thickening of the platform and a widening of the rim of the disc.

SUMMARY OF THE INVENTION

The present invention seeks to overcome these disadvantages and to propose a solution that ensures good circumferential positioning of the blades whilst avoiding recourse to ribs on the rim or corresponding grooves in the platforms, or to platforms with circular edges.

According to the invention, in a rotor for a compressor or turbine of a gas turbine engine, there is provided a rotor disc having a rim and means defining a circumferentially extending groove in said rim, said groove having side walls defining a reduced width mouth opening at said rim, and an array of blades secured to said rotor disc around said rim thereof, each of said blades comprising:

a platform having radially inner and outer faces, an aerofoil portion fixed to and projecting radially outwardly from said outer face of said platform, a raised portion on said inner face of said platform extending in a circumferential direction over substantially the whole of the circumferential length of said platform, said raised portion having a width substantially equal to the width of said mouth of said groove in said disc rim, and a bulbous root of the hammer-head type fixed to and projecting radially inwardly from said raised portion at a position spaced from the ends thereof, said root being received in said groove in said disc rim to secure said blade on said disc, and said raised portion being received as a close fit in said mouth of said groove to ensure the correct alignment of said blade on said disc.

DESCRIPTION OF THE PREFERRED EMBODIMENTS

Figure 3:
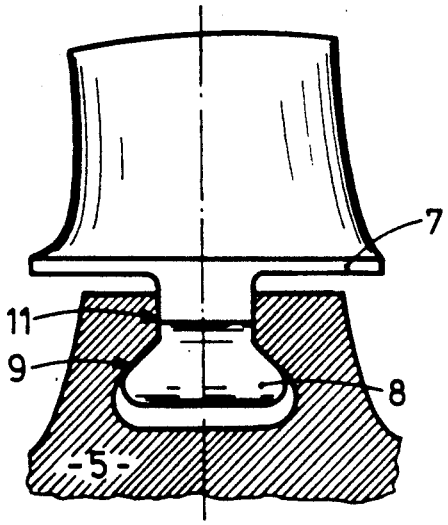
FIG. 3 is a view similar to that of FIG. 1 but showing one example of a blade fixing arrangement in accordance with the invention.
Figure 4:
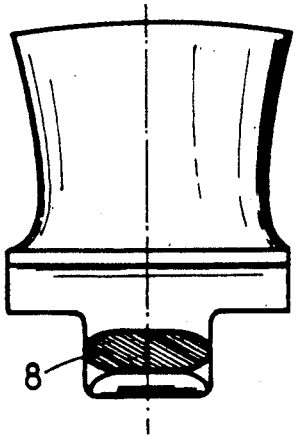
FIG. 4 is a front view of the blade shown in FIG. 3, i.e. looking in the direction of the axis of the disc.
Figure 5:
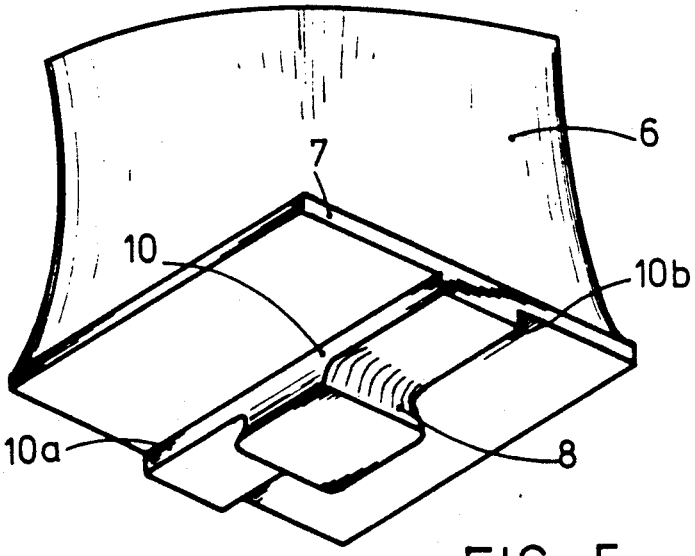
FIG. 5 is a perspective view similar to FIG. 2, but showing a blade in accordance with the invention similar to that shown in FIGS. 3 and 4.

FIGS. 3, 4 and 5 show a blade comprising an aerofoil portion 6, a platform 7 and, underneath the platform, a machined or cast bulbous portion 8 forming the blade root which is designed to ensure the wedging of the blade in the corresponding circumferential groove 9 of the disc.

The bulbous root 8 is connected to the platform 7 by a raised portion 10 which fits closely in the reduced width mouth 11 of the groove 9 which opens in the rim of the disc. The raised portion 10 extends both sides of the bulbous root 8 over the whole circumferential length of the platform, and fits into the groove 11 in such a way that the upstream and downstream faces **10*a* and 10*b* of the raised portion work in conjunction with the walls of the groove mouth 11** to ensure the precise alignment of the blade in relation to the disc, this alignment being considerably improved by virtue of the fact that the engagement of the raised portion with the walls of the groove mouth occurs over the whole circumferential length of the blade.

Figure 1:
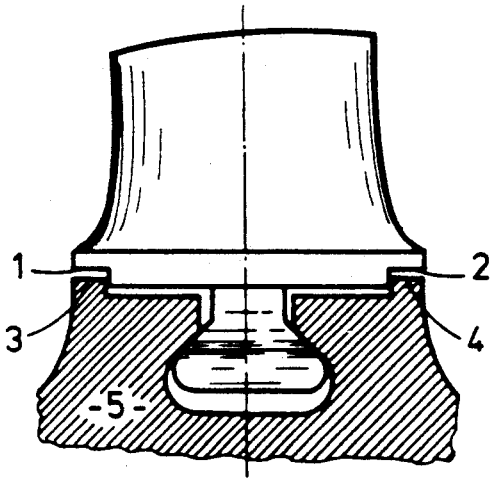
FIG: 1 PRIOR ART
FIG. 1 is a partial longitudinal section through the rim of a compressor rotor disc (i.e. a section in a plane containing the axis of the disc) illustrating a known arrangement for fixing a blade to the disc as described earlier.
Figure 2:
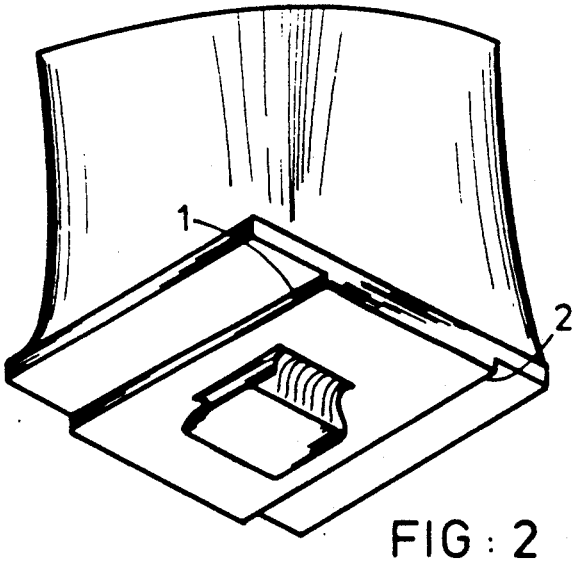
FIG: 2 PRIOR ART
FIG. 2 is a perspective view showing the underside of the platform and the root of the known blade construction shown in FIG. 1.

This manner of ensuring the alignment of the blades by means of the faces **10*a* and 10*b* of the raised portion of the platform enables achievement of a major reduction in the mass of the blade compared with the known solution illustrated in FIGS. 1 and 2**, and therefore reduces the moment of inertia of discs equipped with such blades.

In the arrangement shown in FIG. 5, the raised portion 10 is of constant radial height over its whole length, i.e. over the whole circumferential length of the platform, and the location of the blade is effected over all this length.

Figure 6:
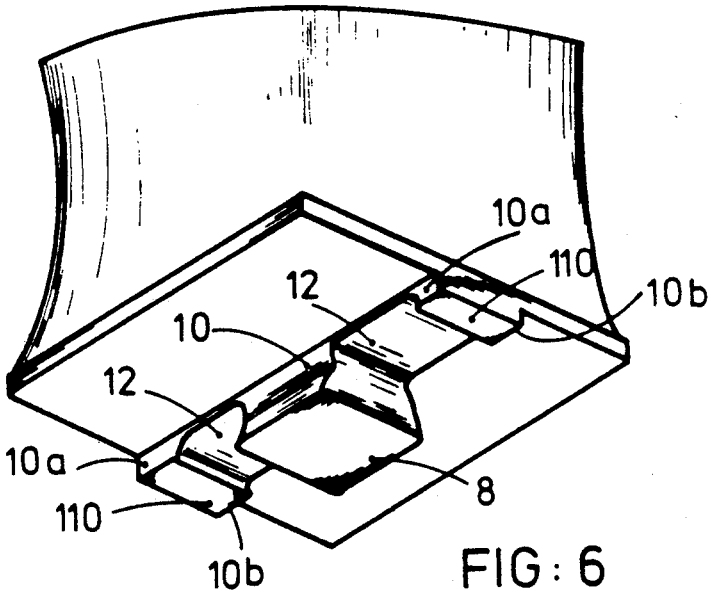
FIG. 6 is a view similar to FIG. 5 but showing a variant of the blade.

In the variant shown in FIG. 6, the raised portion 10 is cut away on each side of the bulbous root 8 as indicated at 12, leaving just the raised sections 110 at each end of the platform. The quality of the alignment of the blade is unaffected by this arrangement, which provides still further lightening of the blade.

The invention finds application in the turbines and compressors of gas turbine engines, especially in high pressure compressors of small diameter and low pitch.

I claim:

1. In a rotor for a compressor or turbine of a gas turbine engine, a rotor disc having a rim and means defining a circumferentially extending groove in said rim, said groove having side walls defining a reduced width mouth opening at said rim, and an array of blades secured to said rotor disc around said rim thereof, each of said blades comprising:

a platform having radially inner and outer faces, an aerofoil portion fixed to and projecting radially outwardly from said outer face of said platform, a raised portion on said inner face of said platform extending in a circumferential direction over substantially the whole of the circumferential length of said platform, said raised portion having a width substantially equal to the width of said mouth of said groove in said disc rim, and a bulbous root of the hammer-head type fixed to and projecting radially inwardly from said raised portion at a position spaced from the ends thereof, said root being received in said groove in said disc rim to secure said blade on said disc, and said raised portion being received as a close fit in said mouth of said groove to ensure the correct alignment of said blade on said disc.

2. A rotor in accordance with claim 1, wherein said raised portion of said blade is of a constant radial height and the whole length of said raised portion is received in said groove mouth to ensure the alignment of the blade.

3. A rotor in accordance with claim 1, wherein cutouts are provided in said raised portion of said blade between said bulbous root and each end of said raised portion.

* * * * *

UNITED STATES PATENT AND TRADEMARK OFFICE

CERTIFICATE OF CORRECTION

PATENT NO. : 5,044,886

DATED : September 3, 1991

INVENTOR(S) : Jacques M.P. Stenneler

It is certified that error appears in the above-identified patent and that said Letters Patent is hereby corrected as shown below:

Title page, item (73):
The Assignee is incorrect, should be, --Societe Nationale d'Etude et de Construction de Moteurs d'Aviation "S.N.E.C.M.A.", Paris, France--.

Signed and Sealed this

Fourth Day of May, 1993

*Attest:*

Michael K. Kirk

MICHAEL K. KIRK

*Attesting Officer*

*Acting Commissioner of Patents and Trademarks*